US007141740B2

(12) United States Patent
Ko

(10) Patent No.: US 7,141,740 B2
(45) Date of Patent: Nov. 28, 2006

(54) SOUND SIGNAL WIRE AND PROCESS FOR ENHANCING RIGIDITY THEREOF

(75) Inventor: Joseph Ko, Taipei (TW)

(73) Assignee: Taiwan Maeden Co., Ltd., Taipei (TW)

( * ) Notice: Subject to any disclaimer, the term of this patent is extended or adjusted under 35 U.S.C. 154(b) by 4 days.

(21) Appl. No.: 11/166,349

(22) Filed: Jun. 27, 2005

(65) Prior Publication Data

US 2005/0271235 A1 Dec. 8, 2005

Related U.S. Application Data

(63) Continuation-in-part of application No. 10/318,007, filed on Dec. 13, 2002, now abandoned.

(51) Int. Cl.
*H01B 5/08* (2006.01)

(52) U.S. Cl. ..... 174/128.1; 174/128.2

(58) Field of Classification Search ..... 174/128.1, 174/128.2, 126.1, 126.2, 113 C
See application file for complete search history.

(56) References Cited

U.S. PATENT DOCUMENTS

| | | | | |
|---|---|---|---|---|
| 1,782,812 | A | | 11/1930 | Dibner |
| 1,999,273 | A | | 4/1935 | Austin |
| 3,067,569 | A | | 12/1962 | Kelley, Jr. |
| 4,777,324 | A | | 10/1988 | Lee |
| 4,886,848 | A | * | 12/1989 | Nishiyama et al. ..... 524/109 |
| 5,125,473 | A | | 6/1992 | Sakamoto et al. |
| 5,218,171 | A | | 6/1993 | Aldissi |
| 6,674,011 | B1 | | 1/2004 | Ueno et al. |

FOREIGN PATENT DOCUMENTS

| | | |
|---|---|---|
| JP | 64-64841 | 3/1989 |
| JP | 3-129606 | 6/1991 |
| TW | 87220313 | 12/1998 |

* cited by examiner

*Primary Examiner*—Chau N. Nguyen
(74) *Attorney, Agent, or Firm*—Shoemaker and Mattare

(57) ABSTRACT

A sound signal wire that has higher rigidity to prevent roping effect from reducing sound quality during vibration within a speaker frame, and/or also has a higher flexibility and tensile strength to make the vibrated sound signal wire more durable for use with a speaker for transmitting sound signals is disclosed. The sound signal wire is constructed from sets of weaving wire units which weave onto other sets of support wire units along specific paths, with acetal resin or polyurethane coating the surface of the wire. Each wire unit is comprised of an inner fiber and a conductive metal sheet encompassing the inner fiber, in which the inner fiber is a heat-resistant fiber that is made by a poly meta-aramid fiber mixed-woven with a poly para-aramid fiber.

15 Claims, 7 Drawing Sheets

SOUND SIGNAL WIRE AND PROCESS FOR ENHANCING RIGIDITY THEREOF

CROSS-REFERENCES TO RELATED APPLICATIONS

This is a continuation-in-part application of U.S. patent application Ser. No. 10/318,007.

STATEMENT REGARDING FEDERALLY SPONSORED RESEARCH OR DEVELOPMENT

Not applicable.

BACKGROUND OF THE INVENTION

1. Field of the Invention

The present invention relates to sound signal wires, more specifically a sound signal wire that has a higher rigidity to prevent roping effect from reducing its sound quality during vibration within a speaker frame, and/or a higher flexibility and tensile strength to make the vibrated sound signal wire more durable for use when transmitting sound signals within a speaker.

2. Descriptions of the Related Art

With reference to FIG. 1, a typical speaker 1 includes a speaker frame 2, a diaphragm 3, a damper 4, sound signal wires 5, a magnet 6, magnetic circuits (not shown), a voice coil bobbin (not shown), and a voice coil 7 surrounding the voice coil bobbin. A sound signal is transmitted in the form of currents via the sound signal wires 5 from an external signal input port 8 connected to the speaker frame 2 and the voice coil 7, whereby a magnetic field can be produced within the space where the voice coil 7 and magnet 6 are located. Attraction and repulsion generated between the magnetic field and the magnetic circuit allows the diaphragm to vibrate and produce the desired sound. The speaker 1 is usually provided with a pair of sound signal wires (as so-called Lead Wires, Litz Wires or Tinsel Wires) or two pairs of wires that are in an opposite arrangement as shown in FIG. 1 which is usually used for large dimension speakers such as sub-woofers. Each wire 5 has one end fixed to the speaker frame 2 and coupled to the signal input port 8, and the other end coupled to the voice coil 7. The sound signal wires 5 vibrate vertically together with vibration of the diaphragm 3 to produce sound from the speaker 1.

A currently-used sound signal wire for sound-signal transmission in a speaker is formed by weaving each unit of wires. Each of the weaving wires is composed of an inner fiber and a conductive metal sheet encompassing the inner fiber. The sound signal wire formed by completely weaving wires has relatively low rigidity. When the sound signal exceeds a certain frequency which causes the amplitude of the vibration to increase beyond the desired degree, the sound signal wires also vibrate horizontally or generate rippling vibrations vertically as illustrated by the wires indicated in reference 9 of FIG. 1; this is customarily referred to as a roping effect. The roping effect generated by the over-vibrating sound signal wires 9 may hit the diaphragm 3 or damper 4 to produce noise which seriously decreases the sound quality of the speaker. This undesired effect may also cause the sound signal wires to come into contact with each other, producing a short-circuiting of the sound signals. Even worse, the roping effect may cause the sound signal wires to strike the diaphragm 3 or damper 4, resulting in some serious damage.

In order to eliminate the roping effect, Taiwan Patent No. 087220313 discloses a modified damper of a speaker, wherein a conductive metal layer is coated by a vacuum electroplating process over an upper-end surface and a lower-end surface of the damper. This process allows the conductive metal layer to act as a substitute for a conventional sound signal wire that is electrically connected to a voice coil, thereby preventing the undesired roping effect and noise. U.S. Pat. No. 5,125,473 discloses another damper of the speaker, wherein a sound signal member for transmitting sound signals is fixed to the damper, thereby preventing the sound signal member from cracking with its inadequate rigidity and tensile strength. The foregoing arrangement of replacing sound signal wires by coating the conductive metal layer on the damper or fixing the sound signal member on the damper would make processes of fabricating a speaker more complicated and cost-ineffective. Moreover, operational inaccuracy or imprecision may easily degrade transmission quality of sound signals.

In light of the shortcomings discussed above, modified weaving arrangements are provided to produce a sound signal wire that has higher rigidity and flexibility without having to perform complicated fabrication processes. This sound signal wire prevents the Tinsel wires from producing the roping effect during high-frequency vibrations, in order not to influence the sound quality or cause any undesired damages. It also makes the wires more durable under a frequent or heavy-duty signal input, thereby prolonging the service life of a speaker.

SUMMARY OF THE INVENTION

A primary objective of the present invention is to provide a sound signal wire that connects between a speaker sound input port and a speaker diaphragm, in which the wire is formed by a specific weaving arrangement to allow for higher rigidity which eliminates the occurrence of a roping effect under high-frequency and/or long-lasting vibrations. This sound signal wire is formed by furnishing two groups of wires, wherein the first group of wire units forms a support, and the second group of wire units forms a set of peripheral wires weaving in respect to the support wire units.

Another objective of the invention is to provide a sound signal wire that has a greater tensile strength and a more durable service life, in which each of the wire units constituting the signal wire includes an inner fiber that is made of a super heat-resistant fiber formed by mixed-weaving a poly para-aramid fiber and a poly meta-aramid fiber.

A further objective of the invention is to provide a sound signal wire, in which the wire is dipped in a solution of acetal resin or polyurethane to form a coating on the surface of the wire, thereby increasing the wire rigidity and avoiding the roping effect under the intense vibration of the speaker.

Yet a further objective of the invention is to provide a sound signal wire with the combination of (1) providing the foregoing inner fiber encompassed by a conductive metal sheet as each of the wire units, (2) furnishing two groups of wire units and weaving them into the signal wire, and finally (3) dipping the wire in a specific solution to form an end product that has a relatively high rigidity without the occurrence of the undesired roping effect, and improving the tensile strength, flexibility and durability thereof.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
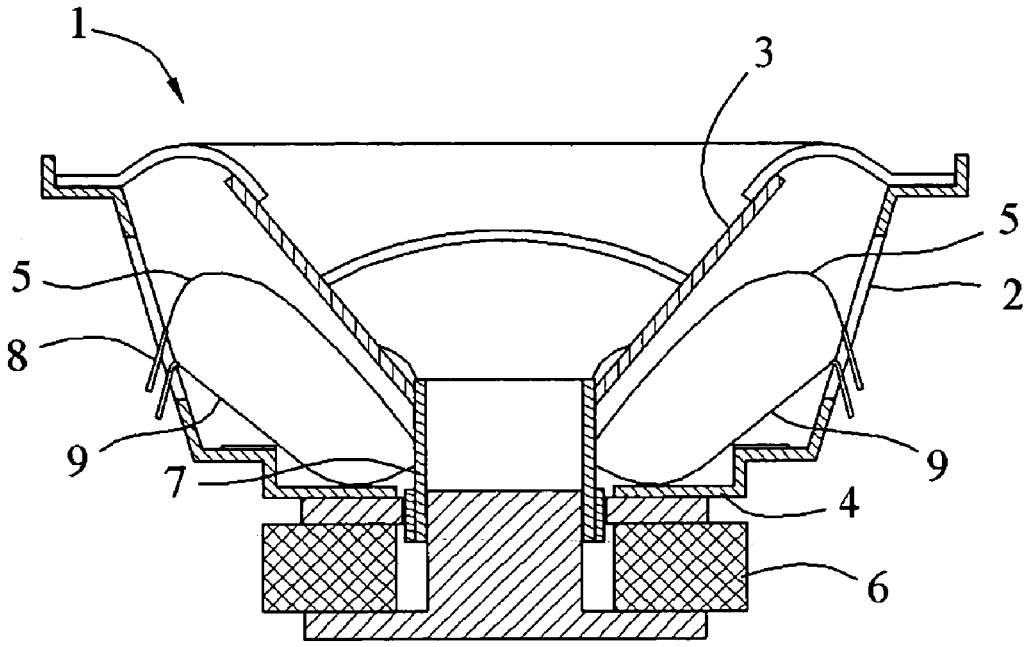
FIG.1(PRIOR ART)
FIG. 1 is a schematic view of a conventional speaker in which the sound signal wire has an undesired roping effect.
Figure 2A:
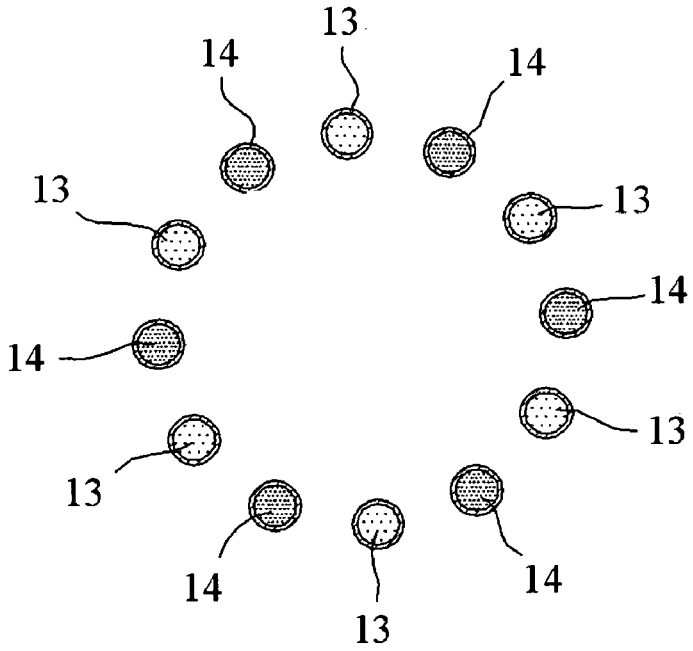
FIG.2A(PRIOR ART)
FIG. 2A is a schematic, cross section view of a conventional arrangement of a sound signal wire with its wire units of 12 strands under static condition before weaving.
Figure 2B:
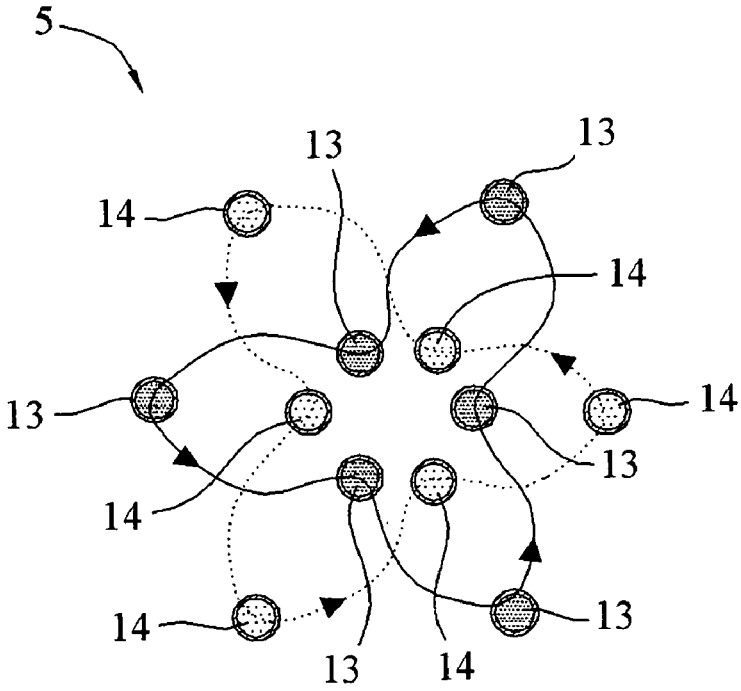
FIG.2B(PRIOR ART)
FIG. 2B is a schematic, cross section view of a conventional arrangement of a sound signal wire with its wire units of 12 strands being woven along specific paths under a weaving process.
Figure 3:
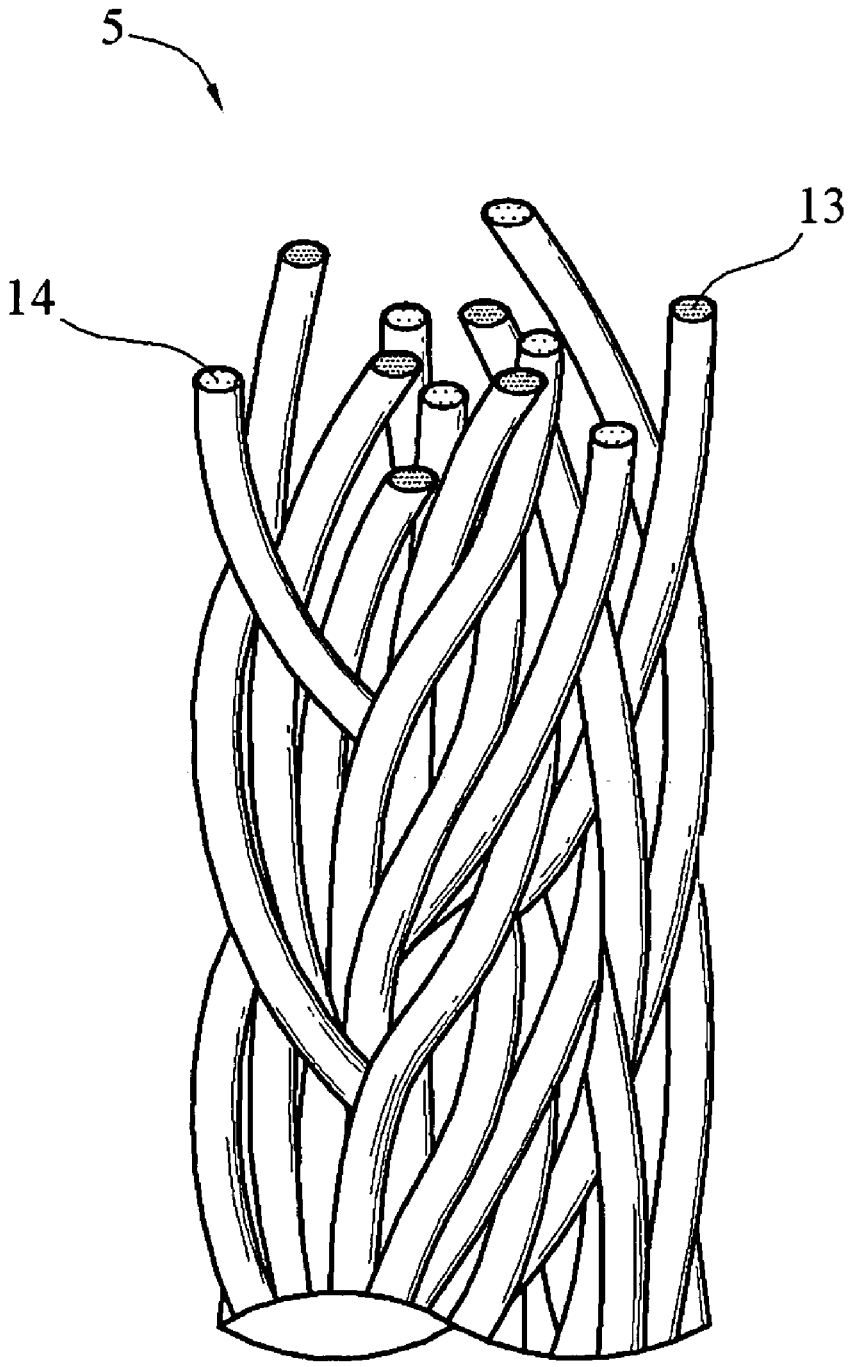
FIG.3(PRIOR ART)
FIG. 3 is a schematic perspective view of a conventional arrangement of a sound signal wire with its wire units of 12 strands being woven by a weaving process.

A sound signal wire 5 fabricated by a conventional weaving method may usually come with weaving wire units of 8 strands, 12 strands, 16 strands, 20 strands or 24 strands, depending on the request of the desired product and the model of a weaving machine. For example, with reference to FIGS. 2A and 2B, a 12-strand sound signal wire is fabricated by a rotationally weaving process by using a weaving machine that has 12 rollers, wherein the rollers are arranged into two groups, and each roller is wound with a strand of wire unit 13 or 14 in specific paths, as shown in FIG. 2B, to perform the rotationally weaving process and constitute an end sound signal wire 5. Similarly, a sound signal wire with the wire units having 8, 16, 20 or 24 strands is fabricated by using a weaving machine having 8, 16, 20 or 24 rollers, respectively.

A conventional weaving machine as stated above is applicable to the present invention. In a sound signal wire that needs, by way of example, the wire units of 12 strands, and made with a weaving machine that has 8 circularly-arranged rollers, 8 strands of weaving wires can be wound to the 8 rollers and then rotated along with the rollers to perform the rotationally weaving process similar to the existing technology. At the center encompassed by the 8 circularly-arranged rollers, there is another set of wires of, for example, 4 strands as a support for the 8 strands weaving wire units.

Figure 4A:
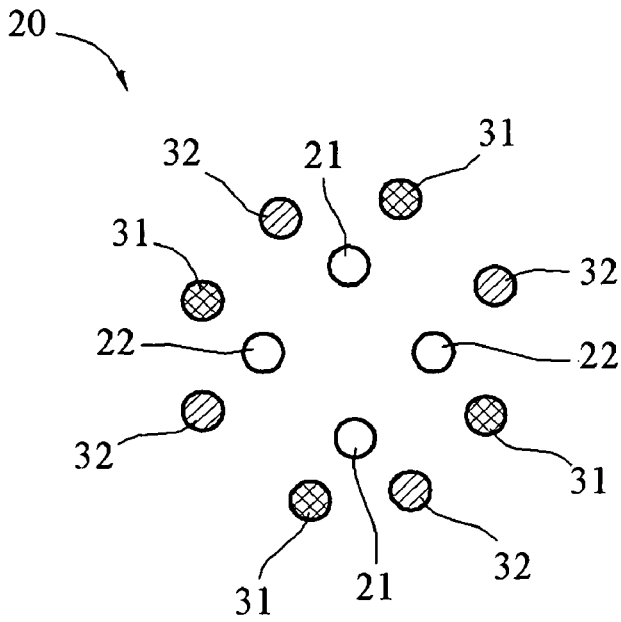
FIG. 4A is a schematic, cross section view of an arrangement of a sound signal wire, according to the present invention, with its wire units of 12 strands under static condition before weaving.
Figure 4B:
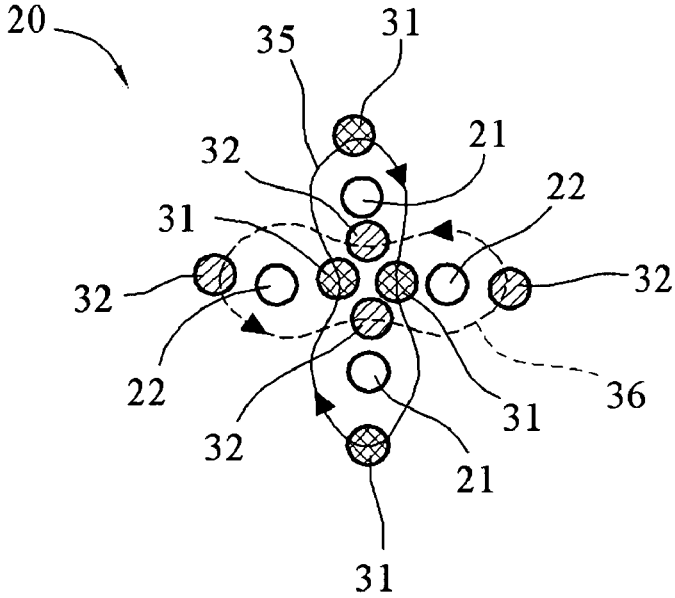
FIG. 4B is a schematic, cross section view of an arrangement of a sound signal wire, according to the present invention, of which the wire units of only 8 strands are woven along specific paths around the other 4.

According to the foregoing embodiment of 8 strands of wire units weaving onto 4 strands of support wire units, with reference to FIGS. 4A and 4B, a sound signal wire 20 comprises a first set of support wire units 21 of two strands which forms a first space within the strands, and a second set of support wire units 22 of two strands which forms a second space within the strands, wherein the first space and second space are virtual and therefore their boundaries are not shown in the figures. These two virtual spaces overlap with each other at a center portion of the support wire units of four strands. The sound signal wire 20 is further comprised of a first set of weaving wire units 31 of four strands, and a second set of weaving wire units 32 of four strands as well. The first set of support wire units 21 and the second set of support wire units 22 are substantially disposed along a circumferential path and alternates with each other to serve as a support for the sound signal wire 20. The support is not dynamically woven with the weaving wire units 31, 32 during the weaving process.

Figure 5:
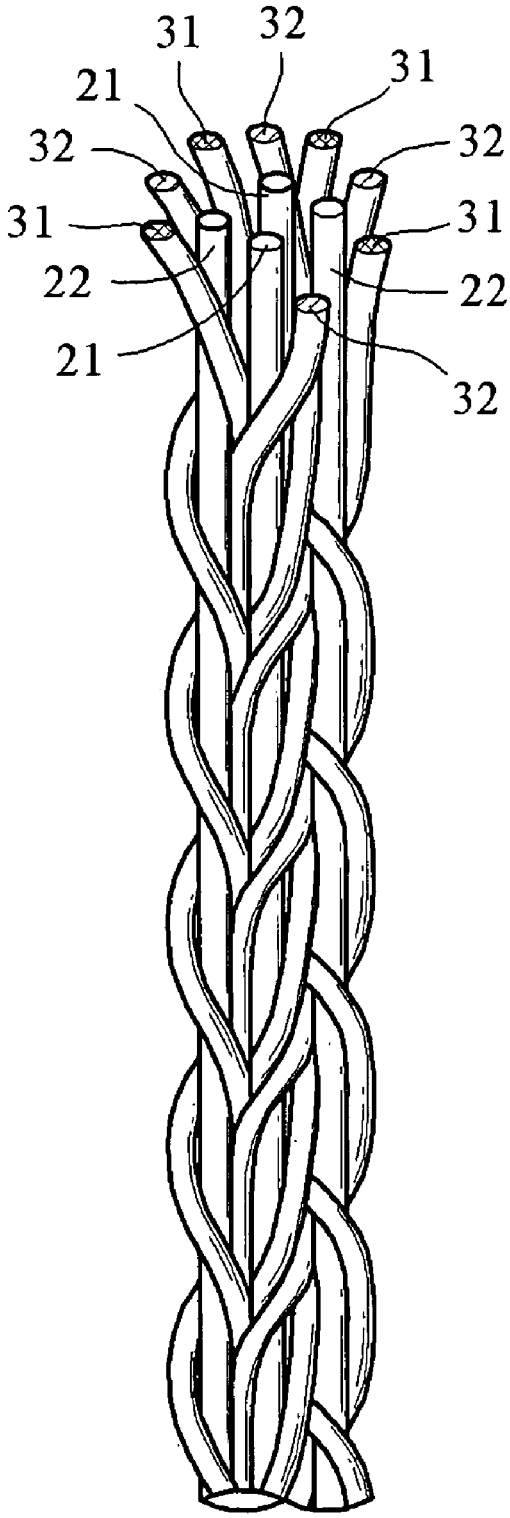
FIG. 5 is a schematic, perspective view of an arrangement of a sound signal wire according to the present invention.

Given the above structures, the weaving wire units 31, 32 weave onto the support wire units 21, 22 by performing a complicated three-dimensional movement. Specifically, the first set of weaving wire units 31 are performed to rotationally, subsequently weave onto the first and second sets of support wire units 21, 22 along a lengthy direction of the signal wire 20, which transversely follows a first path that is substantially a first closed loop 35 (see the solid line shown in FIG. 4B) formed around the first set of support wire units 21 through the second space formed within the second set of support wire units 22. Similarly, the second set of weaving wire units 32 are performed rotationally, subsequently to weave onto the first and second sets of support wire units 21, 22 along a lengthy direction of the signal wire 20, which transversely follows a second path that is substantially a second closed loop 36 (see the dashed line shown in FIG. 4B) formed around the second set of support wire units 22 through the first space formed within the first set of support wire units 21. FIG. 5 shows a schematic, perspective view of the configuration for an arrangement of a sound signal wire according to this embodiment.

In a further embodiment of a sound signal wire that has wire units of 18 strands in total, with a weaving machine that has 12 circularly-arranged rollers, 12 strands of weaving wires can be wound on the 12 rollers and then rotated along with the rollers to perform the rotationally weaving process similar to the former embodiment. At the center encompassed by the 12 circularly-arranged rollers, there is another set of wires of, for example, 6 strands as a support for the 12 strands weaving wire units.

Figure 6A:
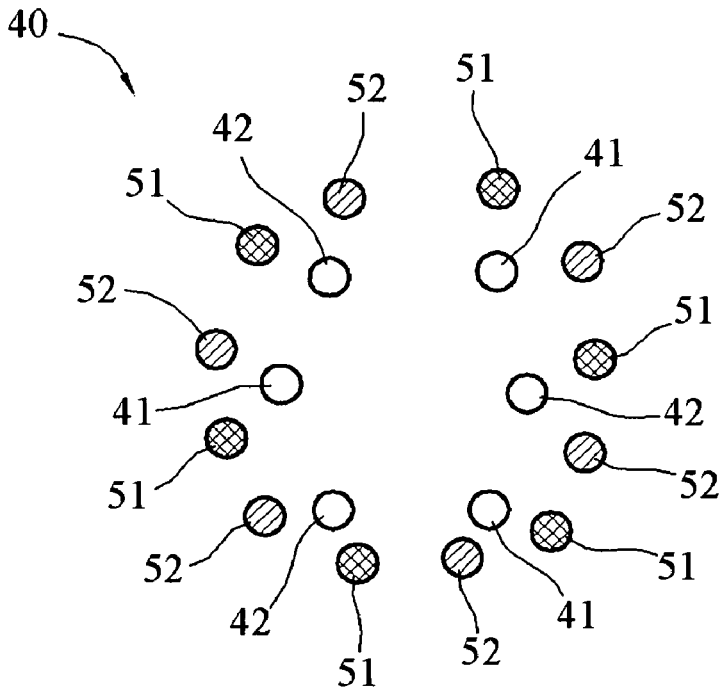
FIG. 6A is a schematic, cross section view of another arrangement of a sound signal wire, according to the present invention, with its wire units of 18 strands under static condition before weaving.
Figure 6B:
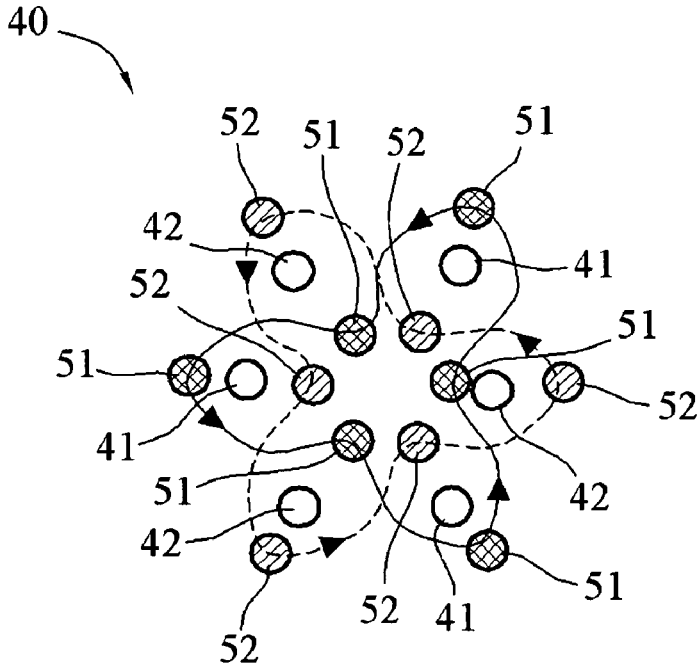
FIG. 6B is a schematic, cross section view of another arrangement of a sound signal wire, according to the present invention, of which the wire units of only 12 strands are woven along specific paths around the other 6.

According to this embodiment of 12 strands of wire units weaving onto 6 strands of support wire units, with reference to FIGS. 6A and 6B, a sound signal wire 40 comprises a first set of support wire units 41 of three strands which forms a first space within the strands, and a second set of support wire units 42 of three strands which forms a second space within the strands, wherein the first space and second space are virtual and therefore their boundaries are not shown in the figures. These two virtual spaces overlap with each other at a center portion of the support wire units of six strands. The sound signal wire 40 is further comprised of a first set of weaving wire units 51 of six strands, and a second set of weaving wire units 52 of six strands as well. The first set of support wire units 41 and the second set of support wire units 42 are substantially disposed along a circumferential path and alternates with each other to serve as a support for the sound signal wire 40. The support is not dynamically woven with the weaving wire units 51, 52 during the weaving process.

Given the above structures in the second embodiment, the weaving wire units 51, 52 weave onto the support wire units 41, 42 by performing a complicated three-dimensional movement. Specifically, the first set of weaving wire units 51 are performed to rotationally, subsequently weave onto the first and second sets of support wire units 41, 42 along a lengthy direction of the signal wire 40, which transversely follows a first path that is substantially a first closed loop 55 (see the solid line shown in FIG. 6B) formed around the first set of support wire units 41 through the second space formed within the second set of support wire units 42. Similarly, the second set of weaving wire units 52 rotationally, subsequently weaves onto the first and second sets of support wire units 41, 42 along a lengthy direction of the signal wire 40, which also transversely follows a second path that is substantially a second closed loop 56 (see the dashed line shown in FIG. 6B) formed around the second set of support wire units 42 through the first space formed within the first set of support wire units 41.

It should be understood that in the use of a conventional weaving machine with 8, 12, 16, 20 or 24 (set this rule as a number of 4N, wherein N is an integral equal to or greater than 2) circularly-arranged rollers, a number of 8, 12, 16, 20 or 24 (4N) strands of weaving wire units are wound respectively on the rollers, and a number of 4, 6, 8, 10 or 12 (set this rule as a number of 2N, wherein N is an integral equal to or greater than 2) strands of support wire units are provided as a basis for being woven by the circularly-arranged rollers to thereby produce a sound signal wire of (4N+2N) strands according to the present invention. More specifically, as set forth in the above two embodiments (N=2 for the first embodiment in FIGS. 4A and 4B and N=3 for the second embodiment in FIGS. 6A and 6B), the support wire units of 2N strands are evenly divided into a first set of support wire units of N strands and a second set of support wire units of N strands; whereas the weaving wire units of 4N strands are evenly divided into a first set of weaving wire units of 2N strands and a second set of weaving wire units of 2N strands. It should be further understood that, the arrangement sound signal wire of the present invention is not limited to the foregoing number of weaving wires. In other words, the number of support wire units and weaving wire units may alter to meet the practical requirement and achieve the intended purposes of increasing rigidity of the wire thereby avoiding the concerned roping effect, provided that the number and the weaving arrangement for the support wire and weaving wire units follows the rules as set forth above.

It is observed that if the sound signal wire is construed under the above arrangement of wire units by dipping it in a solution composed of acetal resin or polyurethane to form a coating on a surface of the sound signal wire, that it may even improve the rigidity superior to that of having no coating. This is because the solution of acetal resin or polyurethane has excellent adhesion and transparency that can be used as an adhesive or coating material. It follows that dissolving acetal resin or polyurethane in a suitable solvent can be coated on the sound signal wire to effectively increase wire rigidity, thereby making the sound signal wire not easily subject to the roping effect by high-frequency and amplitude vibration. There is no particular limitation on the solvent for diluting acetal resin or polyurethane. Any solvent that dissolves acetal resin or polyurethane may be used; however, an alcoholic solvent is normally preferable, such as, but not limited to, methanol, ethanol, propanol or isopropanol. The solution of acetal resin or polyurethane may be coated onto the sound signal wire by any suitable method, such as dipping, spraying, and direct applying. The solution of acetal resin may be further added with a variety of additives, including phosphate ester such as TBP or TCP, phthalate ester (ie: DOP, DPB, and BBP), phosphoric ester, para-phthalic ester, polyethylene glycol, triethylene glycol di-butyrate or Caster oil, to modify the restrictions that resin inherently has, particularly in increasing plasticity.

Figure 7A:
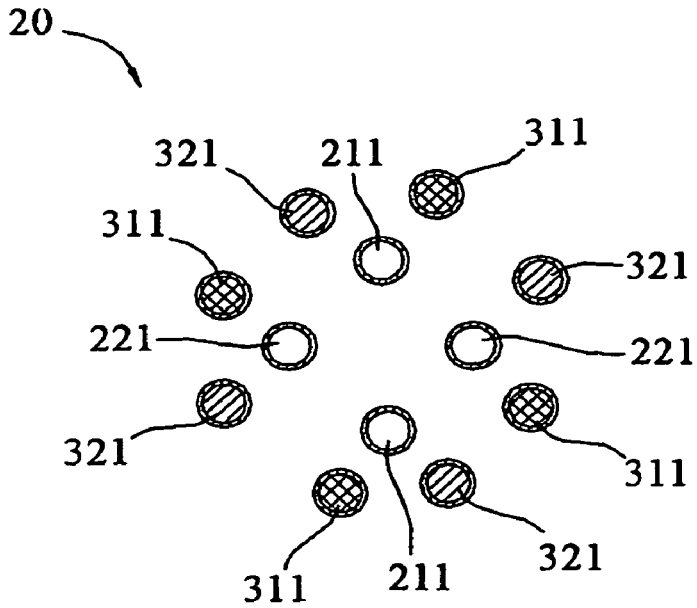
FIG. 7A is a view similar to FIG. 4A, with each of the support wire units and weaving wire units including an inner fiber and a conductive metal sheet encompassing the inner fiber.
Figure 7B:
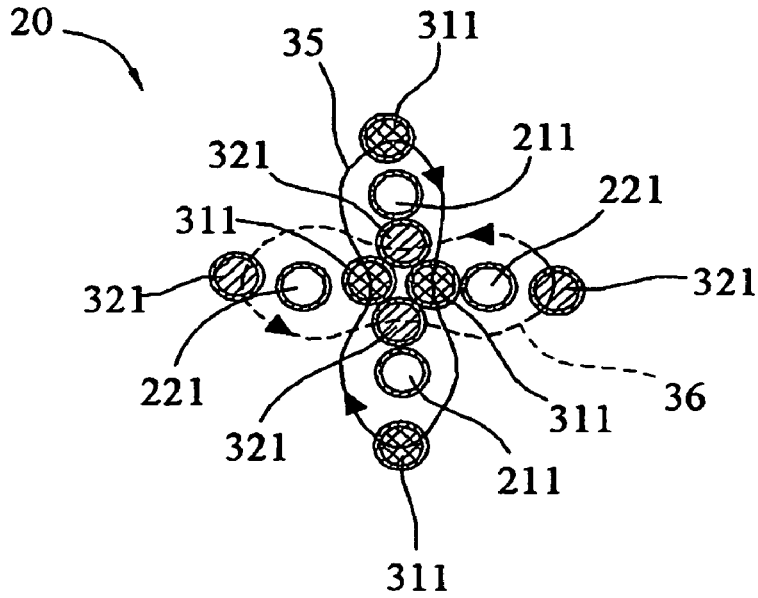
FIG. 7B is a view similar to FIG. 4B, with each of the support wire units and weaving wire units including an inner fiber and a conductive metal sheet encompassing the inner fiber.

More preferably, to further increase the tensile strength and flexibility of the sound signal wire and to make the wire more durable, each of the support wire units 21, 22 and weaving wire units 31, 32 is designed to include an inner fiber 211, 221 and a conductive metal sheet 311, 321 encompassing the inner fiber 211, 221, as shown in FIGS. 7A and 7B which only demonstrate the example of the wire units of 12 strands. The inner fiber 211, 221 is made of textile material that is selected from the group consisting of cotton fiber, rayon fiber, poly-ester fiber and poly-aramid fiber. Among the above poly-aramid fibers, poly meta-aramid fibers have high melting points, high rigidity and a stable size, and usually serve as retardant fibers that are resistant to a high-temperature environment such as that which is created by a high-frequency vibration in the speaker. In another aspect, poly para-aramid fibers have great tensile strength, durability, resistance to chemicals and shock absorbability. They can be used as bulletproof fibers for manufacturing bulletproof vests, bulletproof helmets and anti-explosion equipment. Although many types of poly-aramid fibers have been used to make an inner fiber of the conventional sound signal wire, either a single poly para-aramid fiber or poly meta-aramid fiber is employed. For better flexibility and tensile strength concerns, the inner fiber 211, 221 can be a strong heat-resistant fiber made by a poly meta-aramid fiber mixed-woven with a poly para-aramid fiber, thereby preventing sound signal wire of a speaker from cracks due to frequent vibration. The conductive metal sheet 311, 321 is preferably made of metallic material that is selected from the group consisting of copper, cadmium, tin, silver and an alloy thereof. Coating with silver or tin on the conductive metal sheet 311, 321 can further improve the conductivity.

Supporting Experiments with reference numerals omitted

Examples 1–8 have been created to demonstrate the improved tensile strength and flexibility of the sound signal wire by constructing a wire unit to include an inner fiber and a conductive metal sheet encompassing the inner fiber as stated above.

PREPARATION OF EXAMPLE 1

Poly meta-phendioyl meta-phenylene diamide is used as a textile material for an inner fiber. The inner fiber is made with its specification of a 40-in-2 strand (wherein the "40-in-2" means that the diameter of each of the 2 strands is 40 Ne) and encompassed by a single sheet of copper foil coated with silver to form a wire unit. Then, 7 strands of the wire units are wound and then subjected to anti-oxidation treatment at 82° C. to form Sample 1 of the sound signal wire.

PREPARATION OF EXAMPLE 2

The formation of Sample 2 of the sound signal wire similarly follows the above process of Preparation Example 1, except that the inner fiber is encompassed by two sheets of copper foil coated with silver to form the wire unit.

PREPARATION OF EXAMPLE 3

The formation of Sample 3 of the sound signal wire similarly follows the above process of Preparation Example 2, except that the inner fiber is made with its specification of a 30-in-3 strand (wherein the "30-in-3" means that the diameter of each of the 3 strands is 30 Ne).

PREPARATION OF EXAMPLE 4

The formation of Sample 4 of the sound signal wire similarly follows the above process of Preparation Example 3, except that instead of using 7 strands, only 4 strands of the wire units are wound.

PREPARATION OF EXAMPLE 5

Mixed Poly meta-phendioyl meta-phenylene diamide and poly para-phendioyl para-phenylene diamide are used as the textile material of the inner fiber, which is made with its specification of a 40-in-2 strand and encompassed by a single sheet of copper foil coated with silver to form a wire unit. Then, 7 strands of the wire units are wound and then subjected to anti-oxidation treatment at 82° C. to form Sample 5 of the sound signal wire.

PREPARATION OF EXAMPLE 6

The formation of Sample 6 of the sound signal wire similarly follows the above process of Preparation Example 5 except that the inner fiber is encompassed by two sheets of copper foil coated with silver to form the wire unit.

PREPARATION OF EXAMPLE 7

The formation of Sample 7 of the sound signal wire similarly follows the above process of Preparation Example 6, except that the inner fiber is made with its specification of a 30-in-3 strand.

PREPARATION OF EXAMPLE 8

The formation of Sample 8 of the sound signal wire similarly follows the above process of Preparation Example 7, except that instead of using 7 strands, only 4 strands of the wires are wound.

Samples 1 to 8 of the sound signal wire produced by Preparation Examples 1 to 8, respectively, are subject to tests for tensile strength, flexibility and conductivity, with test results shown in Table 1 below.

As shown in Table 1, the sound signal wire that is made of a strong heat-resistant fiber, fabricated by mixed-weaving poly meta-aramid fiber and poly para-aramid fiber (with reference to Samples 5–8), has greater tensile strength and flexibility, and lower conductor resistance than the conventional sound signal wire formed by a single type of poly meta-aramid fiber (with reference to Samples 1–4).

Examples 9–10 have been created to demonstrate the improved rigidity of the sound signal wire by constructing a sound signal wire to separately arrange sets of support wire units and weaving units that will be woven onto the fixed support wire units as stated above, resulting in an elimination of the concerned roping effect

PREPARATION OF EXAMPLE 9

Mixed poly meta-phendioyl meta-phenylene diamide and poly para-phendioyl para-phenylene diamide are used as the textile material of the inner fiber, which is made with its specification of a 40-in-2 strand and encompassed by cadmium/copper alloy to form a weaving wire unit. Then, according to the conventional weaving method, 12 strands of the weaving wire units are rotationally woven by using a weaving machine that has 12 rollers arranged in a manner so that the 12 strands of the weaving wires rotate in a circular path along with the 12 rollers respectively; subsequently, the woven wire units are subjected to anti-oxidation at 82° C. to form Sample 9 of the sound signal wire with 12 strands of weaving wire units.

PREPARATION OF EXAMPLE 10

The above process is similarly performed to form weaving wire units. By using a weaving machine with 8 rollers, 8 weaving wire units are placed on the 8 circularly-arranged rollers, while the 8 strands of the weaving wires are rotationally woven onto 4 support wire units along specific paths, and rotated in a circle path along with the 8 rollers to thereby encompass the centrally-situated weaving wire units, as arranged in the manner shown in FIGS. 4A and 4B according to the present invention. Then, the woven wire units are subjected to anti-oxidation treatment at 82° C. to form Sample 10 of the sound signal wire.

Samples 9 and 10 were tested by vertical vibration and subjected to different rotation speeds. Vibration condition is recorded in Table 2 below. By looking at the data, it is clear to see that using the arrangement which weaves the wire units of 8 strands to the fixed support wire units of 4 strands (i.e. Sample 10) effectively eliminates the occurrence of the undesired roping effect.

TABLE 1

| No | Break Load (kgs) | | No | No | Flex Life at 270° bending (times) | | No | No | Conductor Resistance (Ohm/meter) | | No |
|---|---|---|---|---|---|---|---|---|---|---|---|
| 1 | 8.53 | 10.52 | 5 | 1 | 43,806 | 183,898 | 5 | 1 | 0.8245–0.8292 | 0.7278–0.7385 | 5 |
| 2 | 8.22 | 10.06 | 6 | 2 | 71,911 | 190,558 | 6 | 2 | 0.4474–0.4526 | 0.3952–0.3975 | 6 |
| 3 | >10 | 16.00 | 7 | 3 | 118,878 | 363,963 | 7 | 3 | 0.5495–0.5600 | 0.4481–0.4733 | 7 |
| 4 | 8.93 | 12.56 | 8 | 4 | 71,555 | 190,777 | 8 | 4 | 1.0365–1.0502 | 0.8242–0.8477 | 8 |

TABLE 2

| No. | Rotation Speed (rpm) | Amplitude of Vibration (cm) | Roping Effect |
|---|---|---|---|
| 9 | 3000 | 2 | Yes |
| 10 | | 1.5 | No |
| 9 | 3920 | 2.5 | Yes |
| 10 | | 1.8 | No |

Examples 11–12 have been created to demonstrate the improved rigidity of the sound signal wire by coating a specific layer on the surface of a sound signal wire as stated above, resulting in an elimination of the concerned roping effect.

PREPARATION OF EXAMPLE 11

Example 11 is prepared under the same condition as the foregoing Example 9.

PREPARATION OF EXAMPLE 12

Example 12 is prepared under the same condition as the foregoing Example 9 except that the sound signal wire is coated with a solution of acetal resin (using methanol as a solvent) to form Sample 12 of the sound signal wire.

Samples 11–12 are tested for their vibration by the same method used for Examples 9–10, and different rotation speeds are conducted and vibration condition is recorded in Table 3 below. It has been found that Sample 11 is prone to the roping effect, but not Sample 12. This shows that coating with the solution of acetal resin can effectively increase rigidity of the sound signal wire to prevent the occurrence of the undesired roping effect.

TABLE 3

| No. | Rotation Speed (rpm) | Amplitude of Vibration (cm) | Roping Effect |
|---|---|---|---|
| 11 | 3000 | 2.0 | Yes |
| 12 | | 1.3 | No |
| 11 | 3920 | 2.5 | Yes |
| 12 | | 1.7 | No |

PREPARATION OF EXAMPLE 13

Example 13 is prepared under the same condition as the foregoing Example 9.

PREPARATION OF EXAMPLE 14

Example 14 is prepared under the same condition as the foregoing Example 9, except that the sound signal wire is further coated with a solution of polyurethane to form Sample 14 of the sound signal wire.

Samples 13–14 are tested for their vibration by the same method used for Examples 9–10, and different rotation speeds are conducted and vibration condition is recorded in Table 4 below. It has been found that Sample 13 is prone to the roping effect, but not Sample 14. This shows that coating with the solution of polyurethane can effectively increase rigidity of the sound signal wire to prevent the occurrence of the undesired roping effect.

TABLE 4

| No. | Rotation Speed (rpm) | Amplitude of Vibration (cm) | Roping Effect |
|---|---|---|---|
| 13 | 3000 | 2.0 | Yes |
| 14 | | 1.4 | No |
| 13 | 3920 | 2.5 | Yes |
| 14 | | 1.8 | No |

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A sound signal wire, comprising:

a first set of support wire units of N strands which forms a first space within the strands;

a second set of support wire units of N strands which forms a second space within the strands;

a first set of weaving wire units of 2N strands;

a second set of weaving wire units of 2N strands; wherein: N is an integer equal to or greater than two;

the first set of support wire units and the second set of support wire units are substantially disposed along a circumferential path and alternate with each other to serve as a support for the sound signal wire, and the first space overlaps the second space at a center portion thereof;

the first set of weaving wire units rotationally, subsequently weave onto the first and second sets of support wire units along a lengthwise direction of the signal wire, which transversely follows a first path that is substantially a first closed loop formed around the first set of support wire units through the second space formed within the second set of support wire units; and the second set of weaving wire units rotationally, subsequently weave onto the first and second sets of support wire units along a lengthwise direction of the signal wire, which transversely follows a second path that is substantially a second closed loop formed around the second set of support wire units through the first space formed within the first set of support wire units.

2. The sound signal wire as claimed in claim 1, wherein N is 2.

3. The sound signal wire as claimed in claim 1, wherein N is 3.

4. The sound signal wire as claimed in claim 1, wherein each of the support wire units and weaving wire units is composed of an inner fiber and a conductive metal sheet encompassing the inner fiber.

5. The sound signal wire as claimed in claim 4, wherein the inner fiber is made of textile material selected from the group consisting of cotton fiber, rayon fiber, poly-ester fiber and poly-aramid fiber.

6. The sound signal wire as claimed in claim 5, wherein the conductive metal sheet is made of metallic material selected from the group consisting of copper, cadmium, tin, silver and an alloy thereof.

7. The sound signal wire as claimed in claim 6, wherein the conductive metal sheet is coated with silver.

8. The sound signal wire as claimed in claim 6, wherein the conductive metal sheet is coated with tin.

9. The sound signal wire as claimed in claim 4, wherein the inner fiber is a heat-resistant fiber made by a poly meta-aramid fiber mixed-woven with a poly para-aramid fiber.

10. The sound signal wire as claimed in claim 9, further comprising acetal resin coated on a surface of the sound signal wire.

11. The sound signal wire as claimed in claim 10, wherein the acetal resin further comprises an additive to increase plasticity, in which the additive is selected from the group consisting of phosphoric ester, para-phthalic ester, polyethylene glycol, triethylene glycol di-butyrate and Caster oil.

12. The sound signal wire as claimed in claim 9, further comprising polyurethane coated on a surface of the sound signal wire.

13. The sound signal wire as claimed in claim 1, further comprising acetal resin coated on a surface of the sound signal wire.

14. The sound signal wire as claimed in claim 13, wherein the acetal resin further comprises an additive to increase plasticity, in which the additive is selected from the group consisting of phosphoric ester, para-phthalic ester, polyethylene glycol, triethylene glycol di-butyrate and Caster oil.

15. The sound signal wire as claimed in claim 1, further comprising polyurethane coated on a surface of the sound signal wire.

* * * * *